US007032562B1

(12) United States Patent
Hoskins

(10) Patent No.: US 7,032,562 B1
(45) Date of Patent: Apr. 25, 2006

(54) ADJUSTABLE GUIDE PLATE ASSEMBLY

(75) Inventor: Paul W. Hoskins, Farmington Hills, MI (US)

(73) Assignee: Dart Machinery, Ltd., Troy, MI (US)

( * ) Notice: Subject to any disclaimer, the term of this patent is extended or adjusted under 35 U.S.C. 154(b) by 0 days.

(21) Appl. No.: 11/103,218

(22) Filed: Apr. 11, 2005

(51) Int. Cl.
*F01L 1/46* (2006.01)

(52) U.S. Cl. ..... 123/195 A; 123/90.61

(58) Field of Classification Search ..... 123/195 A, 123/195 R, 90.61, 90.43, 90.1
See application file for complete search history.

(56) References Cited

U.S. PATENT DOCUMENTS 3,086,507 A 4/1963 Mooney
4,453,505 A 6/1984 Holtzberg et al.
4,850,315 A 7/1989 Mallas
4,856,467 A 8/1989 Kronich
5,027,763 A 7/1991 Mallas
5,044,329 A 9/1991 Jamora
5,069,173 A 12/1991 Mallas
5,507,100 A * 4/1996 Magnet et al. ..... 33/603
6,257,189 B1 7/2001 Moretz et al.

* cited by examiner

*Primary Examiner*—Henry C. Yuen
*Assistant Examiner*—Hyder Ali
(74) *Attorney, Agent, or Firm*—Warner Norcross & Judd LLP

(57) ABSTRACT

An adjustable pushrod guide plate assembly including a first plate and a second plate. Each plate defines an adjustment slot. The plates are in an at least partially overlapping configuration, the slots are optionally aligned, and a shaft is disposed at least partially through the slots to join the plates. The shaft can be a fastener adapted to be manipulated to secure the plates in a variety of fixed configurations.

16 Claims, 3 Drawing Sheets

ADJUSTABLE GUIDE PLATE ASSEMBLY

BACKGROUND OF THE INVENTION

The present invention relates to guide plates for use with internal combustion engines which include overhead valves, and a related method of assembly.

Many internal combustion engines include overhead valves that regulate the intake of fuel and air into one or more combustion chambers, as well as exhaust out of the chambers. Pushrod guide plates are usually employed with overhead valves to align a rocker arm with a tip of a valve, both in longitude and latitude, that is, the plate squares and positions properly (from left to right) the rocker arm relative to the tip of the valve.

Guide plates typically are positioned between the rocker arms and the bosses atop the cylinder head of the engine. The plates generally include two holes for mounting the guide plate to the cylinder head with bolts, and two slots, one of which is dedicated to guiding an intake pushrod, the other of which is dedicated to guiding an exhaust pushrod.

Most guide plates are mass-produced using conventional manufacturing techniques, such as stamping. Mass-produced plates are usually constructed from a single piece of rigid material.

A problem with conventional guide plates is that although they are usually well-manufactured, slight deformations that occur during stamping can make the plates incompatible with and unacceptable for high performance factory or aftermarket cylinder heads. Additionally, when installing conventional guide plates on highly specialized or high performance engines, which include intake cylinder ports and/or exhaust ports that have been relocated, the pushrods usually fail to align with those conventional plates.

A proposed solution to this problem is disclosed in U.S. Pat. No. 5,044,329 to Jamora, which shoes a two-part guide plate, where one plate includes a tab and the other plate includes a complimentary slot. The two plates can be moved, tab in slot, until a desired configuration is achieved, after which the plates can be welded together. Although this construction offers a partial solution, it also has its shortcomings. For example, if the pieces are welded, there is no way to correct any misalignment that may have occurred while the pieces were being welded—short of cutting and re-welding the pieces. Further, if the guide plates are removed and the pushrod position is altered, the welded guide plate parts must be cut and welded again to accommodate the new position. Finally, in some cases, the welding of the plates causes slight warping of the plates, which can alter alignment of components.

SUMMARY OF THE INVENTION

The aforementioned problems are overcome by a two-piece pushrod guide plate assembly which includes a first piece and a second piece, each piece including a pushrod guide slot, a plate mounting aperture, and corresponding adjustment apertures. A shafted element and/or fastener is positioned through the apertures to join the first piece and the second piece. Optionally, the pieces can be in a partially overlapping configuration, with the fastener tightened to secure the pieces in a fixed orientation relative to one another.

A method for assembling the guide plate assembly is also provided. In one embodiment, the method includes providing the specialized guide plate assembly pieces; positioning the first piece adjacent the second piece so that the adjustment apertures of each piece are at least partially aligned, and positioning a fastener at least partially through the apertures to join the pieces. Optionally, the method can include placing the pieces in a partially overlapping configuration, and fastening the fastener.

The guide plate assembly and related method provide a simple and inexpensive, fully adjustable guide plate assembly that is easy to install and use with any high performance factory or after market valve trains. In addition, the guide plate assembly overcomes the conventional problems associated with one-size-fits-all, mass-produced guide plates. For example, it provides the adjustability necessary to accommodate overhead valve trains where pushrod placement has been altered and/or near perfect alignment of components is required.

These and other objects, advantages and features of the invention will be more readily understood and appreciated by reference to the detailed description of the invention and the drawings.

DETAILED DESCRIPTION OF THE INVENTION

Figure 1:
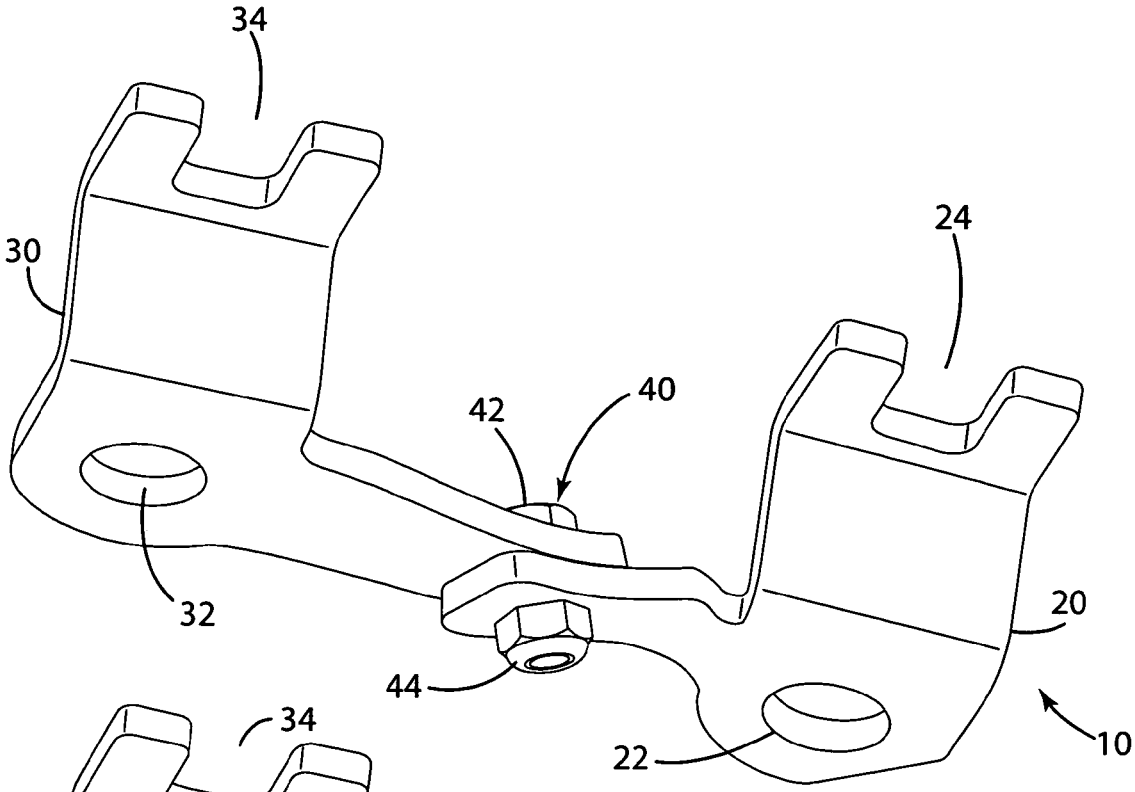
FIG. 1 is a perspective view of a guide plate assembly of one embodiment.

An embodiment of the guide plate assembly is shown in FIGS. 1–4 and generally designated 10. The guide plate assembly includes two pieces 20 and 30. Each piece 20, 30 of the assembly includes a mounting aperture 22, 32 along with a pushrod guide slot 24, 34, respectively. The mounting apertures are designed to accommodate a mounting fastener 102 (FIG. 3) that secures the plate to a cylinder head 100 of the engine. The pushrod guide slots 24 are adapted to properly align the pushrods 104. In general, one guide plate assembly 10 is dedicated to a single cylinder and associated portion of the valve train of an internal combustion engine. The components of the guide plate assembly, including the fasteners and pieces, can be constructed from various materials including steel, titanium, alloys and other metals and/or synthetic materials.

Each guide plate piece further includes respective arms 26 and 36 which project toward one another. The pieces further define mounting apertures 43 and 41. As used herein, aperture can mean a hole, slot, recess or combination thereof. As shown, the apertures 43 and 41 are generally in the shape of slightly elongated slots. These apertures, however, can be formed in any desired shape, for example, as elongated slots, moon-shaped slot, or for example, as holes that are slightly oversized relative to the fastener 40.

The fastener 40 is positioned at least partially through each of the apertures 43 and 41 to join the pieces 20 and 30. The fastener may include complimentary portions, for example, as shown, a threaded bolt 42 and a nut 44, which can be tightened to secure the pieces 20 and 30 in a fixed orientation relative to one another. Although the fastener shown includes a nut and bolt combination, the fastener 40 can be other types of fasteners, such as screws, rivets, grommets and the like as desired. Other shafted elements, which means any element with a shaft of any shape or cross section and can include fasteners, can be used to join the pieces as desired.

Figure 3:
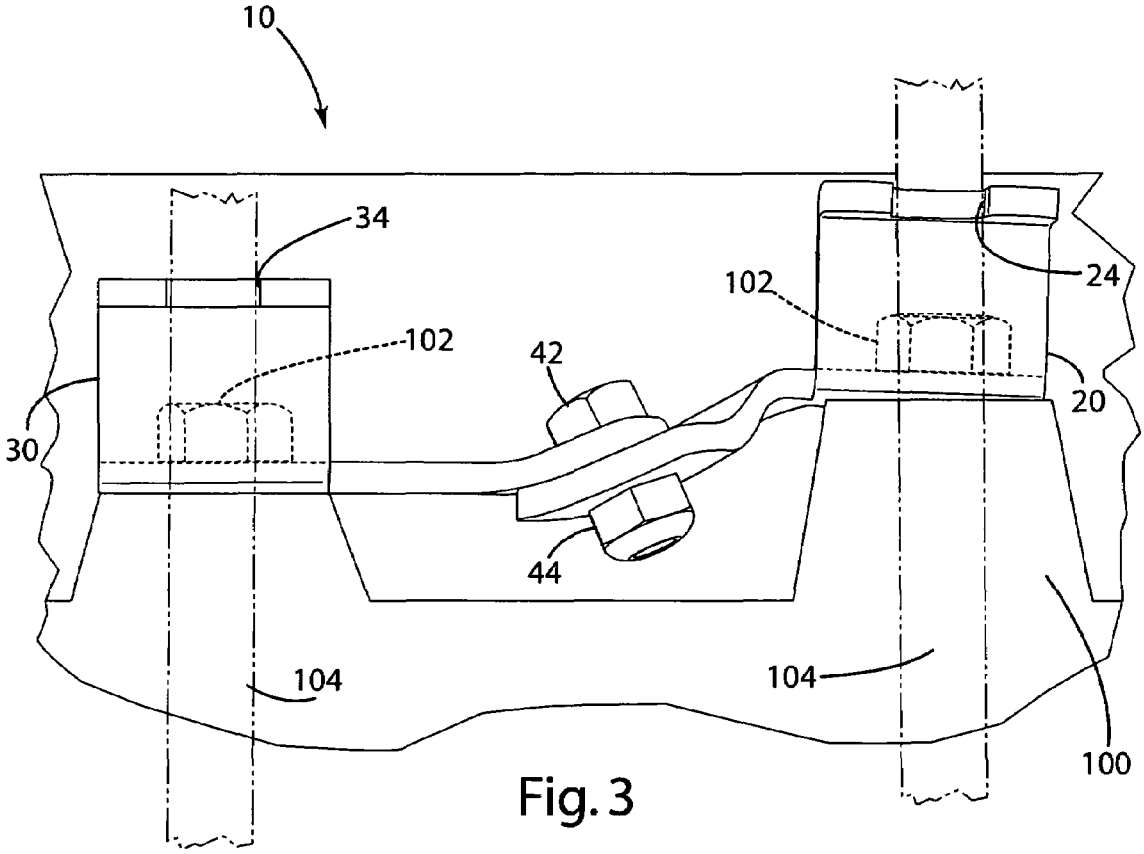
FIG. 3 is a front view thereof, the assembly being mounted to a cylinder head.
Figure 4:
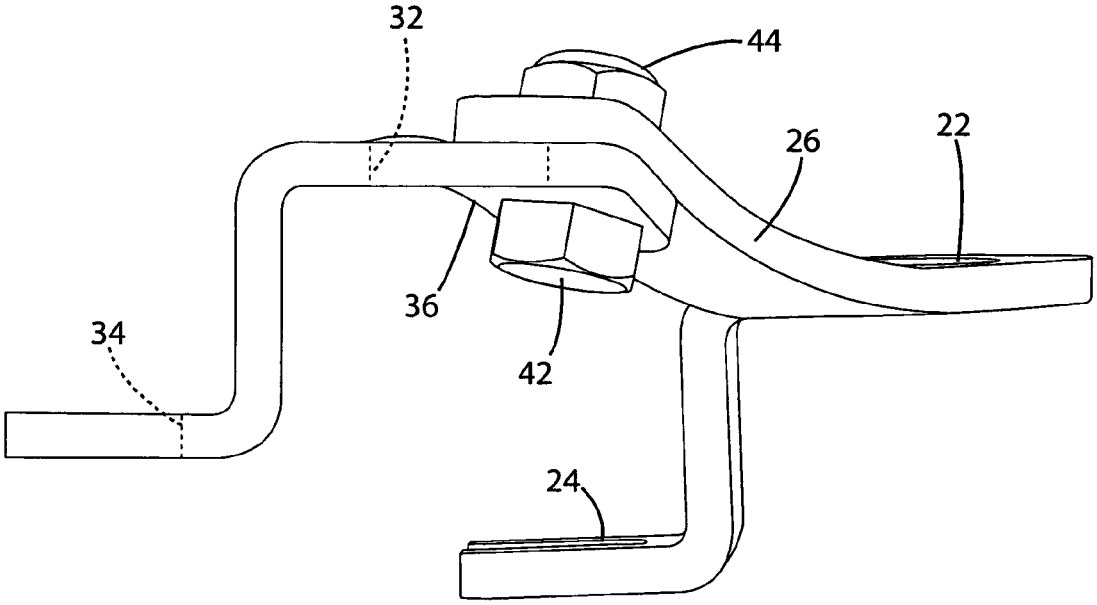
FIG. 4 is a side view thereof.
Figure 5:
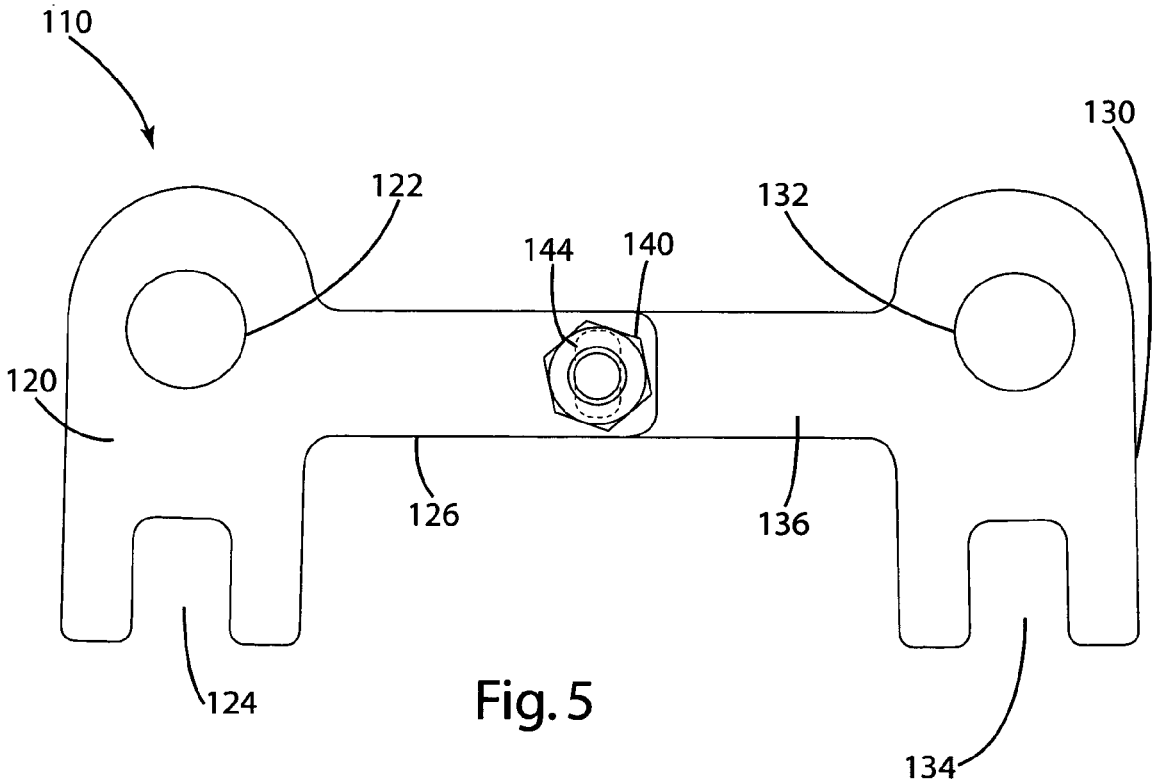
FIG. 5 is a first alternative embodiment of the guide plate assembly.

In the embodiment shown in FIGS. 3 and 4, the guide plate slots 24, 34 and mounting apertures 22, 32 of the separate pieces 20 and 30 can be configured so that they rest in different planes. As shown, the first pushrod slot 24 is in a different plane from the second pushrod slot 34. The relative planes in which the slots and apertures are located can vary as desired. For example, FIG. 5 illustrates an alternative embodiment of the guide plate assembly 110 including first and second pieces 120, 130 which are in the form of flat, partially overlapping plates. The pieces 120 and 130, however, are almost in the same plane, giving the assembly a flatter profile than the embodiment described above. The pieces 120 and 130 of this embodiment, however, are secured together using the same components as the embodiment described above, that is, a fastener 140 is positioned at least partially through aligned adjustment apertures 144 of the pieces.

Returning to the embodiment shown in FIGS. 1–4, the first piece 20 and second piece 30 are in an at least partially overlapped configuration, where part of one piece 20 overlaps the other piece 30. In this configuration, the apertures 41 and 43 are at least partially aligned in the region through which the fastener 40 is positioned. When tightened, the fastener can compress the overlapped pieces together in a secured orientation.

Figure 2:
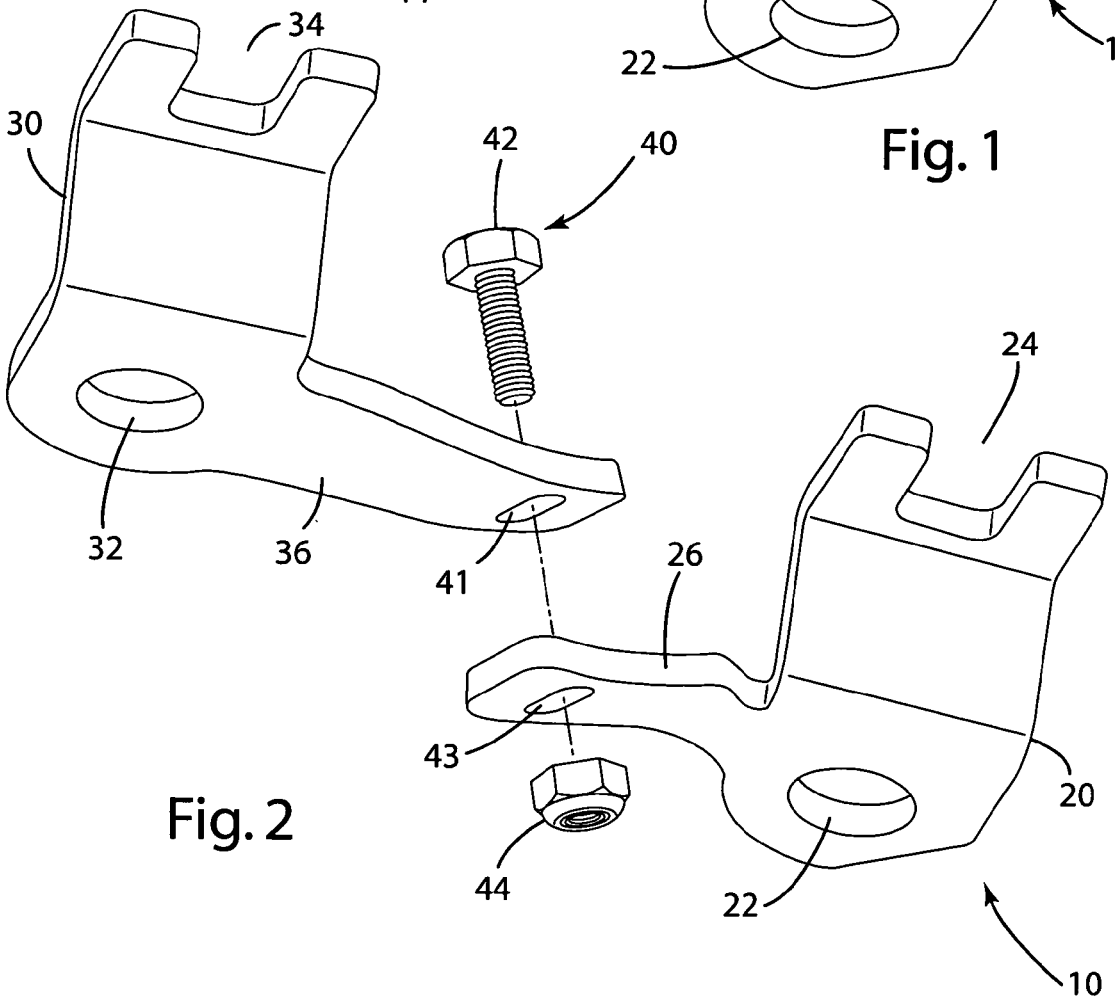
FIG. 2 is an exploded perspective view thereof.

Assembly of the guide plate 10 will now be described in connection with FIGS. 1–3. Generally, the guide plate pieces 20 and 30 are positioned near one another. With the adjustment apertures 41 and 43, at least partially aligned, the fastener 40 is positioned at least partially through both of the apertures 41 and 43. The fastener 40 can be tightened at that point to compress the pieces 20 and 30 against one another. The entire guide plate 10 is then positioned on the head 100, the mounting studs 102 are inserted through the respective mounting holes 22 and 32 to secure the guide plate to the head. The pushrods 104 are inserted through the pushrod guide slots 24 and 34. The remainder of the engine valve train is set into place and the positioning of the pushrods is determined. After appropriate pushrod placement has been determined, the fastener 40 is tightened to secure the pieces 20 and 30 in a fixed position relative to one another and ensure proper pushrod alignment.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The invention claimed is:

1. An adjustable pushrod guide plate assembly that guides pushrods in an internal combustion engine comprising:

a first guide plate piece including a first pushrod guide slot, and including a first guide plate arm defining a first mounting aperture and a first adjustment aperture;

a second guide plate piece, formed separately and independently from the first guide plate piece, the second guide plate piece including a second pushrod guide slot and including a second guide plate arm defining a second mounting aperture and a second adjustment aperture, the first and second guide plate arms at least partially overlapping so that the first adjustment aperture and the second adjustment aperture are at least partially aligned; and a fastener positioned at least partially through the first adjustment aperture and the second adjustment aperture, the fastener joining the first guide plate piece and the second guide plate piece.

2. The adjustable pushrod guide plate assembly of claim 1 wherein the fastener includes a bolt and a corresponding nut.

3. The adjustable pushrod guide plate assembly of claim 1 wherein the first adjustment aperture is a first slot and the second adjustment aperture is a second slot.

4. The adjustable pushrod guide plate assembly of claim 1 wherein the fastener joins the first guide plate piece and second guide plate piece, and enables rotational movement of the first and second guide plate pieces relative to one another.

5. The adjustable pushrod guide plate assembly of claim 4 wherein the first guide plate piece includes a first surface and a second surface, the second guide plate piece includes a third surface and a fourth surface, wherein the second surface contacts the third surface when the guide plate pieces are at least partially overlapping.

6. An adjustable pushrod guide plate assembly that guides pushrods in an internal combustion engine comprising:

a first guide plate including a first pushrod guide slot, and including a first guide plate arm defining a first mounting aperture and a first adjustment slot;

a second guide plate being formed separately and independently from the first guide plate, the second guide plate including a second pushrod guide slot and including a second guide plate arm defining a second mounting aperture and a second adjustment slot, the second guide plate arm at least partially overlapping the first guide plate arm so the first adjustment slot and the second adjustment slot are at least partially aligned; and a shafted element positioned through both at least partially aligned slots of the at least partially overlapping guide plate arms, the shafted element joining the first and second guide plates and adapted to be adjusted to hold the first and second guide plates in a fixed orientation relative to one another.

7. The adjustable pushrod guide plate assembly of claim 6 wherein the shafted element is a bolt and nut combination, the nut being tightened to snugly hold the first plate and second guide plate against one another.

8. The adjustable pushrod guide plate assembly of claim 6 wherein the first plate and the second guide plate are constructed from metal.

9. The adjustable pushrod guide plate assembly of claim 6 wherein the first pushrod guide slot is positioned in a first plane, and the second pushrod guide slot is positioned in a second plane, different from the first.

10. A method for assembling an adjustable pushrod guide plate assembly that guides pushrods in an internal combustion engine comprising:

providing a first guide plate piece including a first pushrod guide slot and including a first guide plate arm defining a first mounting aperture and a first adjustment aperture, and a separate second guide plate piece including a second pushrod guide slot and including a second guide plate arm defining a second mounting aperture and a second adjustment aperture;

positioning the first guide plate arm of the first guide plate piece adjacent and at least partially overlapping the second guide plate arm of the second guide plate piece so that the first adjustment aperture and the second adjustment aperture are at least partially aligned; and positioning a fastener at least partially through the first adjustment aperture of the first guide plate arm and the second adjustment aperture of the second guide plate arm so that the fastener joins the first guide plate piece and the second guide plate piece.

11. The method of claim 10 comprising tightening the fastener so that the first guide plate piece and second guide plate piece are held in a fixed position relative to one another.

12. The method of claim 10 comprising mounting the guide plate assembly on a cylinder head of the internal combustion engine.

13. The method of claim 12 comprising adjusting the position of each guide plate piece until the first pushrod guide slot and second pushrod guide slot are each aligned with a respective pushrod.

14. The method of claim 13 comprising fastening the fastener so that the first guide plate piece and the second guide plate piece are held in a fixed position wherein the first pushrod guide slot and second pushrod guide slot are each aligned with a respective pushrod.

15. The method of claim 14 wherein said fastener includes a nut on a bolt, and wherein said fastening includes tightening the nut on the bolt to compress the first guide plate piece against the second guide plate piece.

16. The method of claim 10 comprising adjusting the orientation of the first guide plate piece relative to the second guide plate piece with the fastener inserted at least partially through the first adjustment aperture and second adjustment aperture.

* * * * *